US007999169B2

(12) United States Patent
Kayama

(10) Patent No.: US 7,999,169 B2
(45) Date of Patent: Aug. 16, 2011

(54) SOUND SYNTHESIZER

(75) Inventor: Hiraku Kayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 171 days.

(21) Appl. No.: 12/477,597

(22) Filed: Jun. 3, 2009

(65) Prior Publication Data

US 2009/0308230 A1 Dec. 17, 2009

(30) Foreign Application Priority Data

Jun. 11, 2008 (JP) ..... 2008-152772

(51) Int. Cl.
*G10H 1/06* (2006.01)

(52) U.S. Cl. ..... 84/622; 84/601; 84/615; 84/653; 84/659; 84/723; 84/735

(58) Field of Classification Search ..... None
See application file for complete search history.

(56) References Cited

U.S. PATENT DOCUMENTS

| | | | | |
|---|---|---|---|---|
| 5,536,902 | A * | 7/1996 | Serra et al. | 84/623 |
| 5,636,283 | A * | 6/1997 | Hill et al. | 381/17 |
| 5,880,392 | A * | 3/1999 | Wessel et al. | 84/659 |
| 5,999,630 | A * | 12/1999 | Iwamatsu | 381/17 |
| 6,239,348 | B1 * | 5/2001 | Metcalf | 84/723 |
| 6,444,892 | B1 * | 9/2002 | Metcalf | 84/723 |
| 6,740,805 | B2 * | 5/2004 | Metcalf | 84/723 |
| 6,992,245 | B2 | 1/2006 | Kenmochi et al. | |
| 7,138,575 | B2 * | 11/2006 | Childs et al. | 84/615 |
| 7,138,576 | B2 * | 11/2006 | Metcalf | 84/723 |
| 7,369,663 | B2 * | 5/2008 | Sekine | 381/63 |
| 7,511,213 | B2 * | 3/2009 | Childs et al. | 84/615 |
| 7,572,971 | B2 * | 8/2009 | Metcalf | 84/723 |
| 7,636,448 | B2 * | 12/2009 | Metcalf | 381/300 |
| 2002/0029686 | A1 * | 3/2002 | Metcalf | 84/723 |
| 2003/0029306 | A1 * | 2/2003 | Metcalf | 84/723 |
| 2003/0202667 | A1 * | 10/2003 | Sekine | 381/63 |
| 2005/0223877 | A1 * | 10/2005 | Metcalf | 84/600 |
| 2007/0056434 | A1 * | 3/2007 | Metcalf | 84/723 |
| 2008/0056517 | A1 | 3/2008 | Algazi et al. | |
| 2008/0247552 | A1 | 10/2008 | Herzog | |

FOREIGN PATENT DOCUMENTS

| | | |
|---|---|---|
| JP | 2003-099078 | 4/2003 |
| JP | 2003-255998 | 9/2003 |
| JP | 2007-240564 | 9/2007 |
| WO | WO-2005/036523 A1 | 4/2005 |
| WO | WO-2007/028922 A1 | 3/2007 |

* cited by examiner

*Primary Examiner* — Marlon T Fletcher
(74) *Attorney, Agent, or Firm* — Morrison & Foerster LLP

(57) ABSTRACT

A sound synthesizer has a storage unit, a setting unit and a sound synthesis unit. The storage unit stores a plurality of sound data respectively representing a plurality of sounds collected by different sound collecting points corresponding to the plurality of the sound data. The setting unit variably sets a position of a sound receiving point according to an instruction from a user. The sound synthesis unit synthesizes a sound by processing each of the plurality of the sound data according to a relation between a position of the sound collecting point corresponding to the sound data and the position of the sound receiving point specified by the user.

6 Claims, 11 Drawing Sheets

MUSIC INFORMATION $Q_A$

| | PITCH | SOUND GENERATION TIME | SOUND ELEMENT |
|---|---|---|---|
| DESIGNATED SOUND 1 | G3 | 00 : 00−00 : 10 | sil_s |
| DESIGNATED SOUND 2 | G3 | 00 : 10−00 : 20 | s_a |
| DESIGNATED SOUND 3 | G3 | 00 : 20−00 : 30 | a |
| DESIGNATED SOUND 4 | A3 | 00 : 30−00 : 35 | a_i |
| ⋮ | ⋮ | ⋮ | ⋮ |

SOUND RECEIVING INFORMATION $Q_B$

| POSITION Pu | DIRECTIONALITY MODE tU | SOUND RECEIVING SENSITIVITY hU | SOUND RECEIVING DIRECTION dU |
|---|---|---|---|

: DESIGNATED SOUND TO WHICH SOUND DATA GROUP G HAS BEEN ALLOCATED

: DESIGNATED SOUND TO WHICH SOUND DATA $D_0$ HAS BEEN ALLOCATED

SOUND SYNTHESIZER

BACKGROUND OF THE INVENTION

1. Technical Field of the Invention

The present invention relates to a technology for synthesizing a sound.

2. Description of the Related Art

A technology has been proposed for synthesizing a desired sound using sound data representing features of sounds that were previously recorded. For example, Patent Reference 1 or Patent Reference 2 describes a technology in which a frequency spectrum specified from sound data is expanded or contracted along the frequency axis according to a desired pitch, and an envelope of the expanded or contracted frequency spectrum is adjusted to synthesize a desired sound.

[Patent Reference 1] Japanese Patent Application Publication No. 2007-240564

[Patent Reference 2] Japanese Patent Application Publication No. 2003-255998

However, the technology of Patent Reference 1 or Patent Reference 2 synthesizes a sound that would be received at a sound collecting point (i.e., at the mounting position of a sound collecting device) where sounds used to generate the sound data were recorded. Thus, the technology cannot synthesize a sound that would be heard at a position which the user designates inside a space in which sounds were recorded.

SUMMARY OF THE INVENTION

The invention has been made in view of these circumstances, and it is an object of the invention to generate a sound that would be heard at a position desired by the user inside a space in which sounds used to generate sound data were recorded.

In order to achieve the above object, a sound synthesizer according to the invention includes a storage that stores a plurality of sound data respectively representing a plurality of sounds collected by different sound collecting points corresponding to the plurality of the sound data, a setting unit that variably sets a position of a sound receiving point according to an instruction from a user, and a sound synthesis unit that synthesizes a sound by processing each of the plurality of the sound data according to a relation between a position of the sound collecting point corresponding to the sound data (for example, a corresponding one of the positions P[1] to P[N] in FIG. 8 or 9) and the position of the sound receiving point (for example, a position $P_U$ in FIG. 8 or 9).

According to this configuration, it is possible to generate a sound that would be heard at a position (i.e., a virtual sound receiving point) desired by the user inside an environment in which sounds used to generate sound data were recorded, since a sound is synthesized by processing each of the plurality of the sound data according to a relation between the position of the sound collecting point corresponding to the sound data and the position of the sound receiving point indicated by the user.

In a preferable embodiment of the invention, the sound synthesis unit synthesizes a sound by processing each of the plurality of the sound data according to a distance (for example, a corresponding one of the distances L[1] to L[N] in FIG. 8) between the sound collecting point corresponding to the sound data and the sound receiving point. According to this embodiment, it is possible to synthesize a sound closer to sounds inside the environment in which the sounds used to generate the sound data were recorded, since changes of sounds according to the distance of the sound receiving point from each sound collecting point are reflected in the synthesized sound.

In a preferable embodiment of the invention, the setting unit variably sets a directionality attribute (for example, a directionality mode $t_U$ or a sound receiving direction $d_U$) of the sound receiving point according to an instruction from a user, and the sound synthesis unit synthesizes a sound by processing each of the plurality of the sound data according to sensitivity that the directionality attribute represents for a direction of the sound collecting point corresponding to the sound data from the sound receiving point.

According to this embodiment, it is possible to synthesize a sound more precisely closer to sounds inside the environment in which sounds used to generate the sound data were recorded, since changes of sounds according to the direction of the sound receiving point from each sound collecting point are reflected in the synthesized sound. In this embodiment, for example, the setting unit sets at least one of a sound receiving direction and a directionality type (for example, the directionality mode $t_U$ in FIG. 3B) as a directionality attribute of the sound receiving point.

In a preferable embodiment of the invention, the sound synthesis unit weights an envelope of a frequency spectrum of a sound represented by each of the plurality of the sound data by a factor (for example, a corresponding one of the weights W[1] to W[N] in FIG. 6) according to a relation between the position of the sound collecting point corresponding to the sound data and the position of the sound receiving point, then calculates a new envelope (for example, an envelope $E_A$ in FIG. 6) by summing the weighted envelopes (for example, envelopes E[1] to E[N] in FIG. 6) of the frequency spectrums of the sounds represented respectively by the plurality of the sound data, and synthesizes the sound based on the new envelope.

In this embodiment, the relation between the position of each sound collecting point and the position of the sound receiving point is reflected in the envelope of the synthesized sound. However, the synthesis method that the sound synthesis unit uses to synthesize a sound or the details of processing performed on the sound data are diverse in the invention.

The sound synthesizer according to each of the above embodiments may not only be implemented by hardware (electronic circuitry) such as a Digital Signal Processor (DSP) dedicated to musical sound synthesis but may also be implemented through cooperation of a general arithmetic processing unit such as a Central Processing Unit (CPU) with a program. A program according to the invention causes a computer, including a storage that stores a plurality of sound data respectively representing a plurality of sounds collected by different sound collecting points corresponding to the plurality of the sound data, to perform a setting process to variably set a position of a sound receiving point according to an instruction from a user, and a sound synthesis process to synthesize a sound by processing each of the plurality of the sound data according to a relation between a position of the sound collecting point corresponding to the sound data and a position of the sound receiving point. The program achieves the same operations and advantages as those of the sound synthesizer according to each of the above embodiments. The program of the invention may be provided to a user through a machine readable recording medium storing the program and then be installed on a computer and may also be provided from a server device to a user through distribution over a communication network and then be installed on a computer.

DETAILED DESCRIPTION OF THE INVENTION

A: First Embodiment

Figure 1:
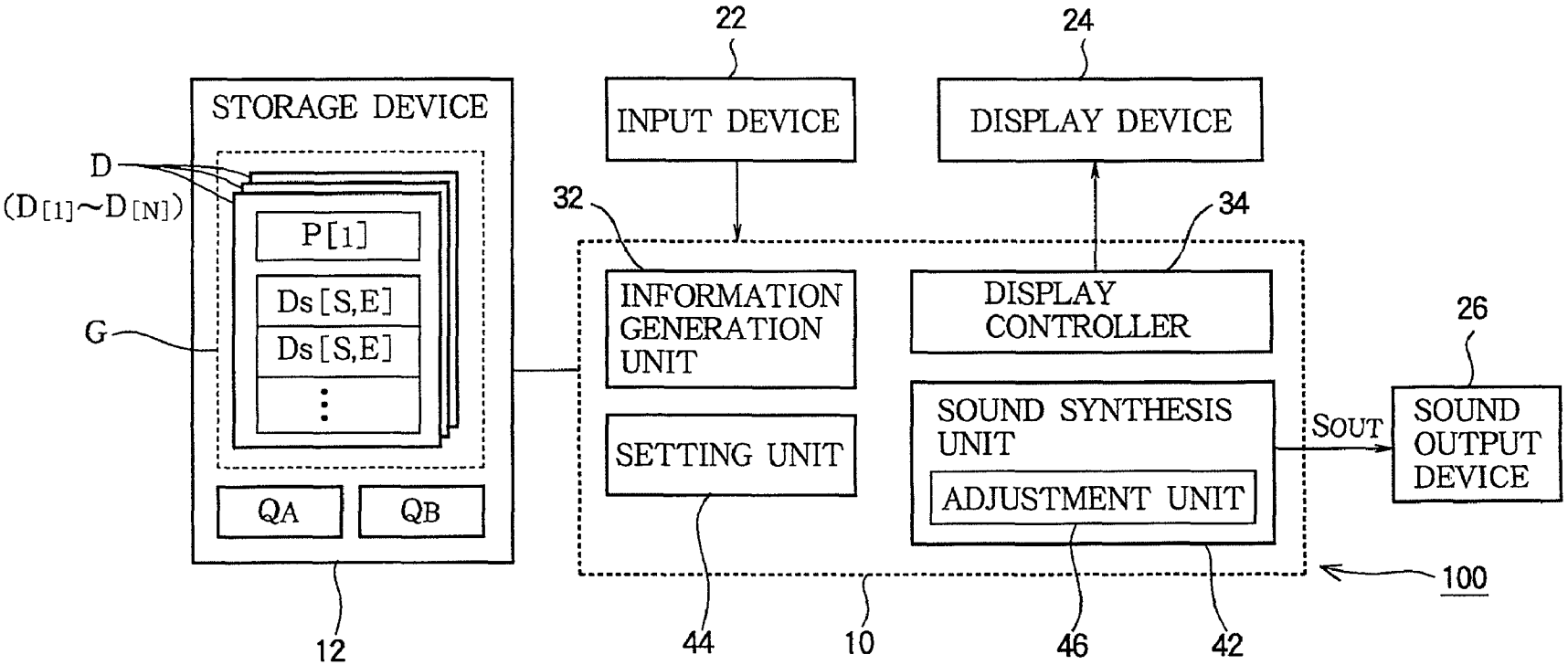
FIG. 1 is a block diagram of a sound synthesizer according to a first embodiment of the invention.

FIG. 1 is a block diagram of a sound synthesizer according to the first embodiment of the invention. As shown in FIG. 1, a sound synthesizer 100 is implemented as a computer system including a control device 10, a storage device 12, an input device 22, a display device 24, and a sound output device 26.

The control device 10 is an arithmetic processing unit that executes a program stored in the storage device 12. The control device 10 of this embodiment functions as a plurality of elements such as an information generation unit 32, a display controller 34, a sound synthesis unit 42, and a setting unit 44 for generating a sound signal $S_{OUT}$ representing the waveform of a sound such as a sound of singing. The plurality of elements that the control device 10 implements may each be mounted in a distributed manner on a plurality of devices such as integrated circuits or may each be implemented by an electronic circuit such as a DSP dedicated to generating the sound signal $S_{OUT}$.

The storage device 12 stores a program that is executed by the control device 10 and a variety of data that is used by the control device 10. Any known recording medium such as a semiconductor storage device or a magnetic storage device may be used as the storage device 12. The storage device 12 of this embodiment stores a sound data group G including N sound data D (or N pieces of sound data D) (D[1], [2], . . . , D[N]) where N is a natural number. The sound data D represents features of a sound that has been previously collected and stored. More specifically, the sound data D includes a plurality of sound element data $D_S$ (or a plurality of pieces of sound element data $D_S$), each corresponding to an individual sound element. Each sound element data $D_S$ includes a frequency spectrum S of a sound element and an envelope E of the frequency spectrum S. The sound element is a phoneme, which is the smallest unit that can be aurally distinguished, or a phoneme chain which is a series of connected phonemes.

Figure 2:
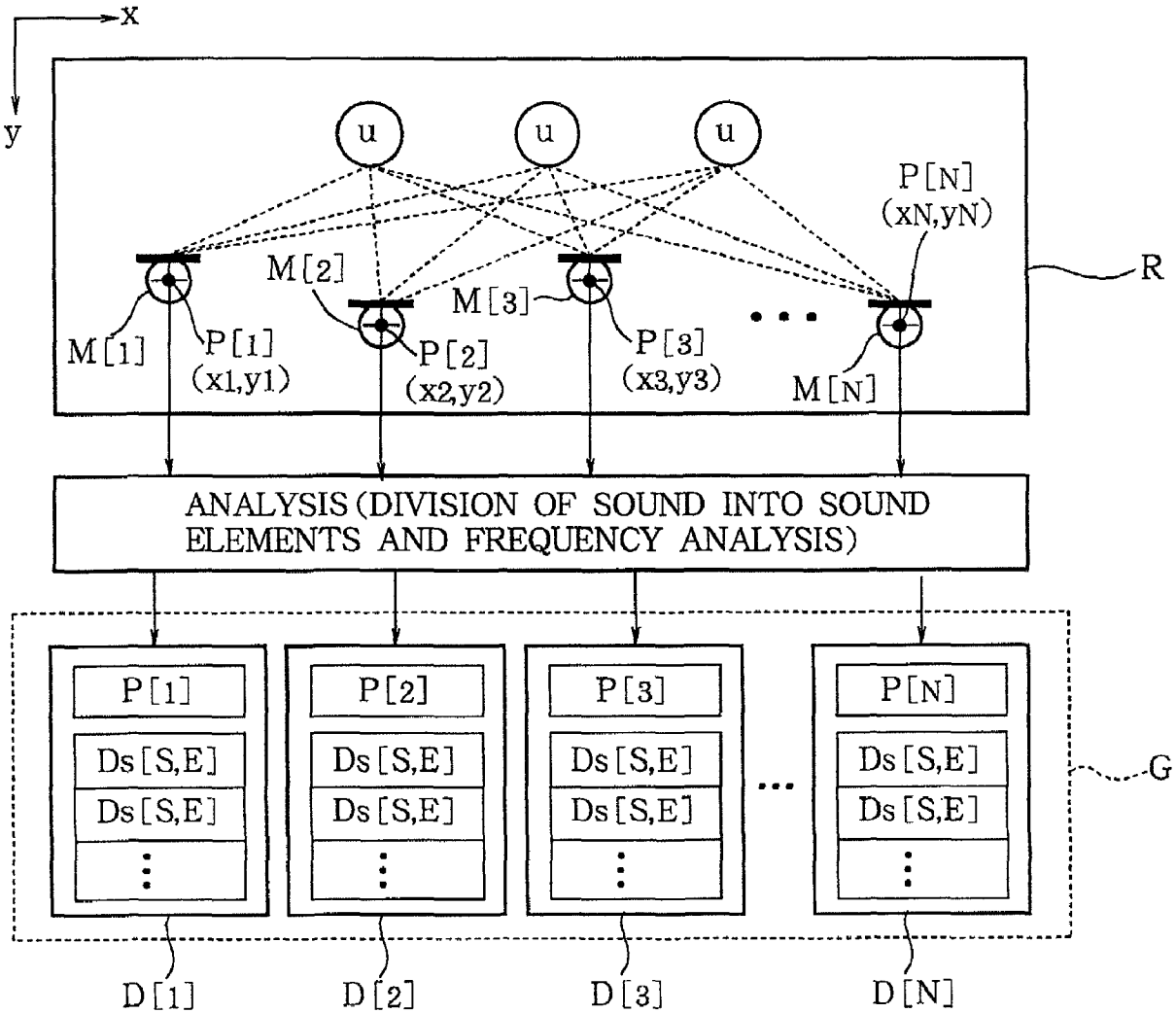
FIG. 2 is a conceptual diagram illustrating generation of sound data.

FIG. 2 is a conceptual diagram illustrating a method for generating sound data D. As shown in FIG. 2, N sound collecting devices M (M[1], M[2], . . . , M[N]) are arranged at different positions P (P[1], P[2], . . . , P[N]) in a space R. Each sound collecting device M is a nondirectional microphone that collects sounds such as choral sounds that a plurality of persons u located at a specific position in the space R generate in parallel.

A sound collected by a sound collecting device M[i] disposed at a position P[i] (i=1–N) is used to generate sound data D[i]. Specifically, as shown in FIG. 2, a sound (specifically, a mixture of vocal sounds generated by a plurality of persons) collected by the sound collecting device M[i] is divided into sound elements, and sound data D[i] is then generated by incorporating, as sound element data $D_S$ of each sound element, a frequency spectrum S and an envelope E which are specified by performing frequency analysis (for example, Fourier transform) on the sound element. As shown in FIGS. 1 and 2, the position P[i] of the sound collecting device M[i], at which the sound has been collected, is added to the sound data D[i]. The position P[i] is defined by coordinates (xi, yi) on an x-y plane set in the space R. The above procedure is performed on each of the sound collecting devices M[1] to M[N] to generate N sound data D[1] to D[N] which constitute the sound data group G. Thus, N sound data D[1] to D[N], which constitute the sound data group G, represent the features of sounds that have been collected in parallel at the individual positions P[1] to P[N] when common sounds such as choral sounds have been simultaneously generated in the space R.

The input device 22 in FIG. 1 is a device (for example, a mouse or keyboard) that the user operates to input an instruction for the sound synthesizer 100. The display device (for example, a liquid crystal display) 24 displays a variety of images based on control of the control device 10 (specifically, by means of the display controller 34). The sound output device 26 is a sound emitting device (for example, a speaker or headphones) which emits a sound wave according to the sound signal $S_{OUT}$ provided from the control device 10.

Figures 3A, 3B, 4:
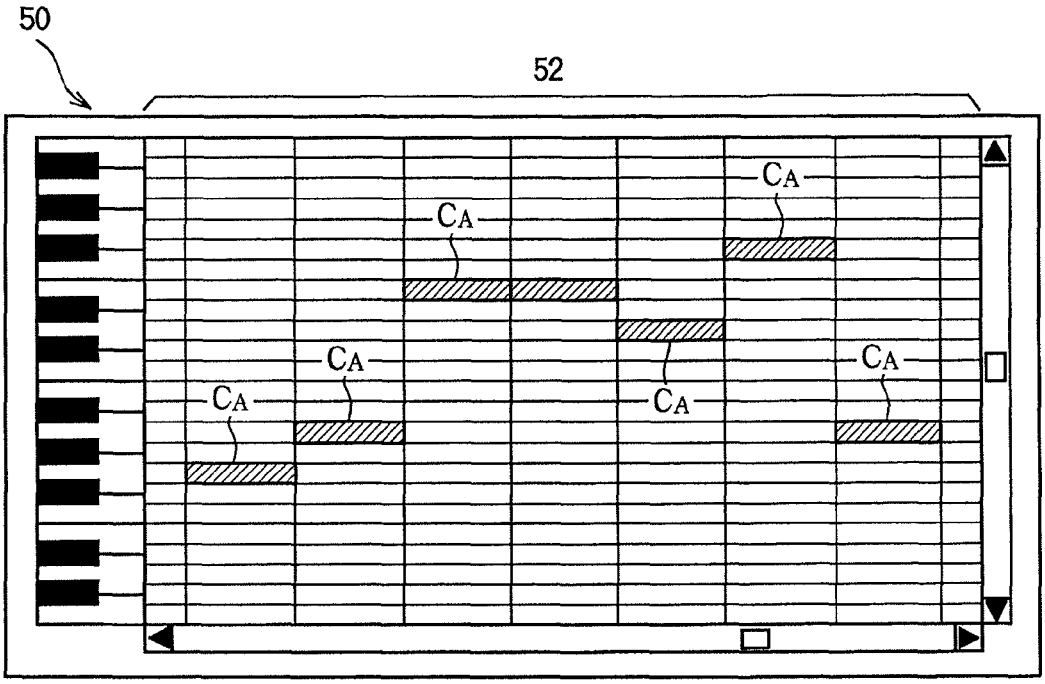
FIGS. 3A and 3B are schematic diagrams of music information and sound receiving information.
FIG. 4 is a schematic diagram of a music editing image.

The information generation unit 32 in the control device 10 generates or edits music information $Q_A$ such as score data, which is used to synthesize a sound, according to an operation that the user performs on the input device 22 and then stores the music information $Q_A$ in the storage device 12. FIG. 3A is a schematic diagram illustrating contents of the music information $Q_A$. The music information $Q_A$ is a data sequence that is used to designate a plurality of sounds (hereinafter, referred to as "designated sounds") to be synthesized by the sound synthesizer 100 in chronological order. As shown in FIG. 3A, in the music information $Q_A$, a pitch (i.e., a note), sound generation time (specifically, the start and end times of generation of the sound), and a sound element are designated for each of the plurality of designated sounds that are arranged in chronological order.

The display controller 34 in FIG. 1 generates and displays an image on the display device 24. For example, the display controller 34 displays a music editing image shown in FIG. 4, which allows the user to edit (create) or check the music information $Q_A$, or a sound receiving setting image shown in FIG. 5, which allows the user to variably set a virtual sound receiving position of the synthesized sound, on the display device 24.

When the user performs an operation for starting editing of the music information $Q_A$ on the input device 22, the display controller 34 displays the music editing image of FIG. 4 on the display device. As shown in FIG. 4, the music editing image 50 includes a work area 52 in the form of a piano roll in which a vertical axis corresponding to the pitch and a horizontal axis corresponding to the time are set. The user designates a pitch and sound generation time of each designated sound by appropriately operating the input device 22 while viewing the music editing image 50. The display controller 34 arranges marks $C_A$ corresponding to the sounds designated by the user in the work area 52. In the following description, the marks are referred to as "indicators". A position of the indicator $C_A$ in the direction of the vertical axis (pitch) of the work area 52 is selected according to a pitch designated by the user and a position or size of the indicator $C_A$ in the direction of the horizontal axis (time) is selected according to the sound generation time (specifically, a sound generation time point or time length) designated by the user.

Each time the user selects a designated sound, the information generation unit 32 stores a pitch and sound generation time indicated by the user, as a pitch and sound generation time of the designated sound in the music information $Q_A$, in the storage device 12. The user designates a lyric character of each indicator $C_A$ (i.e., each designated sound) in the work area 52 by appropriately operating the input device 22. The information generation unit 32 stores a sound element corresponding to the character, which the user has designated for the designated sound, in the music information $Q_A$ in association with the designated sound.

The sound synthesis unit 42 of FIG. 1 synthesizes a sound (specifically, a sound signal $S_{OUT}$) using the sound data group G. More specifically, the sound synthesis unit 42 synthesizes a sound that would be received by a virtual sound receiving point (specifically, a virtual sound receiving device) assuming that the virtual sound receiving point was disposed in the space R when the sound of the sound data group G was recorded. The setting unit 44 sets and stores sound receiving information $Q_B$, which defines the virtual sound receiving point, in the storage device 12 according to an operation that the user performs on the input device 22. As shown in FIG. 3B, the sound receiving information $Q_B$ includes the position $P_U$, the directionality type $t_U$ as a directionality attribute (hereinafter referred to as a "directionality mode"), sound receiving sensitivity $h_U$, and a sound receiving direction $d_U$ of the sound receiving point. Setting of each variable of the sound receiving information $Q_B$ will be described later.

Figure 5:
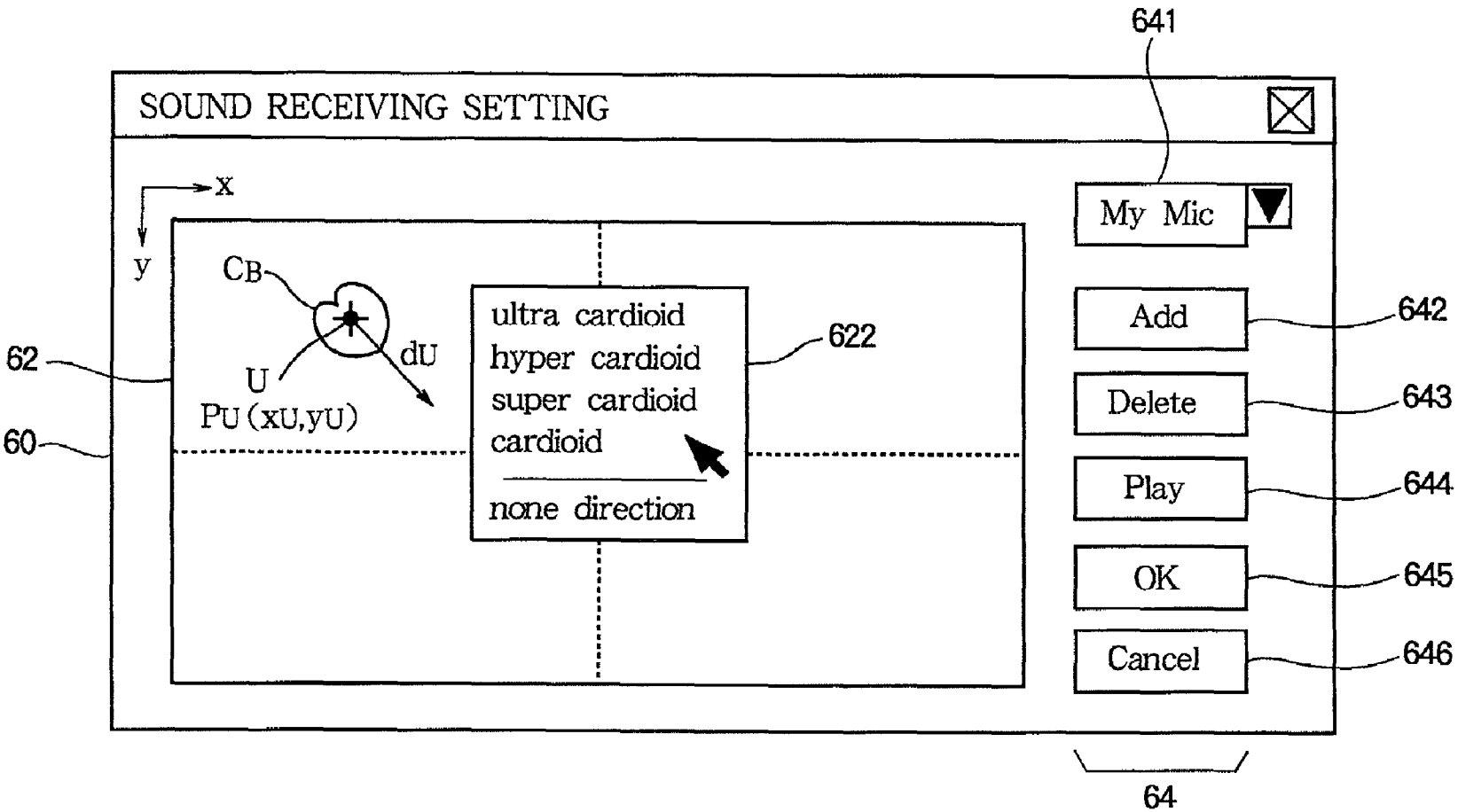
FIG. 5 is a schematic diagram of a sound receiving setting image.

When the user performs an operation for starting generation or editing of the sound receiving information $Q_B$ on the input device 22, the display controller 34 displays the sound receiving setting image 60 of FIG. 5 on the display device 24. As shown in FIG. 5, the sound receiving setting image 60 includes a work area 62 and an operating area 64. An identifier (a file name "My Mic" in the example of FIG. 5) of the sound receiving information $Q_B$ which is to be actually edited (or generated) is displayed in a region 641 in the operating area 64. By changing the identifier in the region 641 through operation of the input device 22, the user can select sound receiving information $Q_B$ that is to be edited (generated) through the setting unit 44.

The work area 62 is a region having a shape corresponding to the space R of FIG. 2 used when the sound data group G is recorded. The user arbitrarily selects a position $P_U$, at which a virtual sound receiving point U is to be disposed, in the work area 62 by appropriately operating the input device 22. The position $P_U$ is defined by coordinates (xU, yU) in the x-y plane set in the work area 62.

The user variably designates the directionality mode $t_U$ at the sound receiving point U (i.e., a directionality attribute of the virtual sound receiving device disposed at the position $P_U$) through operation of the input device 22. For example, as shown in FIG. 5, the display controller 34 displays a list 622 of candidates for the directionality mode $t_U$ (such as ultra cardioid and hyper cardioid) on the display device 24. When the user selects one directionality mode $t_U$ from the list 622 by operating the input device 22, the display controller 34 disposes a mark $C_B$ visually indicating the directionality mode $t_U$ selected by the user at the position $P_U$ in the work area 62. In the following description, the mark $C_B$ visually indicating the directionality mode $t_U$ is referred to as a "directionality pattern". For example, when the user has selected unidirectionality (i.e., cardioid), a directionality pattern $C_B$ having a cardioid shape (i.e., a heart shape) representing the unidirectionality is disposed at the position $P_U$ as shown in FIG. 5.

In addition, the user also variably designates the sound receiving sensitivity $h_U$ at the sound receiving point U (i.e., the gain of the virtual sound receiving device disposed at the position $P_U$) and the sound receiving direction $d_U$ at the sound receiving point U (i.e., a directionality attribute of the virtual sound receiving device disposed at the position $P_U$) through operation of the input device 22. The display controller 34 rotates the directionality pattern $C_B$ to the sound receiving direction $d_U$ designated by the user as shown in FIG. 5.

Each time the user operates an operator (Add) 642 in FIG. 5, the setting unit 44 reflects the variables such as the position $P_U$, the directionality mode $t_U$, the sound receiving sensitivity $h_U$, and the sound receiving direction $d_U$ indicated by the user in sound receiving information $Q_B$ corresponding to the identifier in the region 641. That is, the setting unit 44 variably sets the sound receiving information $Q_B$ stored in the storage device 12 according to an instruction from the user. Although the user directly designates the sound receiving sensitivity $h_U$ in the above example, it is also possible to employ a configuration wherein the setting unit 44 specifies a numerical value of the sound receiving sensitivity $h_U$ from an option that the user has selected from a plurality of options (for example, multiple options including high sensitivity, middle sensitivity, and low sensitivity).

When an operator (Delete) 643 is operated, the setting unit 44 deletes sound receiving information $Q_B$ corresponding to the identifier in the region 641 from the storage device 12. When an operator (Play) 644 is operated, the sound synthesis unit 42 synthesizes a sound signal $S_{OUT}$ of a predetermined sound element using the sound receiving information $Q_B$ that is being edited. The user can generate desired sound receiving information $Q_B$ by editing the sound receiving information $Q_B$ while listening to, as needed, the synthesized sound reproduced through the sound output device 26. On the other hand, when an operator (OK) 645 is selected, the sound receiving setting image 60 is removed after the sound receiving information $Q_B$ that is being edited is fixed, and, when an operator (Cancel) 646 is operated, the sound receiving setting image 60 is removed without reflecting the setting performed after the immediately previous operation of the operator 642 in the sound receiving information $Q_B$.

The sound synthesis unit 42 in FIG. 1 synthesizes a sound (i.e., a sound signal $S_{OUT}$) using the sound data group G (including sound data D[1] to D[N]), the music information $Q_A$, and the sound receiving information $Q_B$. More specifically, the sound synthesis unit 42 sequentially selects each designated sound (hereinafter referred to as a "selected designated sound") in the order of sound generation time in the music information $Q_A$ and acquires sound element data $D_S$, corresponding to a sound element designated for the selected designated sound in the music information $Q_A$, from each of the N sound data D[1] to D[N] of the sound data group G in the storage device 12. The sound synthesis unit 42 generates a sound signal $S_{OUT}$ using the N sound element data $D_S$ acquired from the storage device 12 according to the sound receiving information $Q_B$. In the case where a plurality of sound receiving information $Q_B$ has been stored in the storage device 12, the sound synthesis unit 42 uses sound receiving information $Q_B$, which the user has selected using the input device 22, to synthesize the sound.

Figure 6:
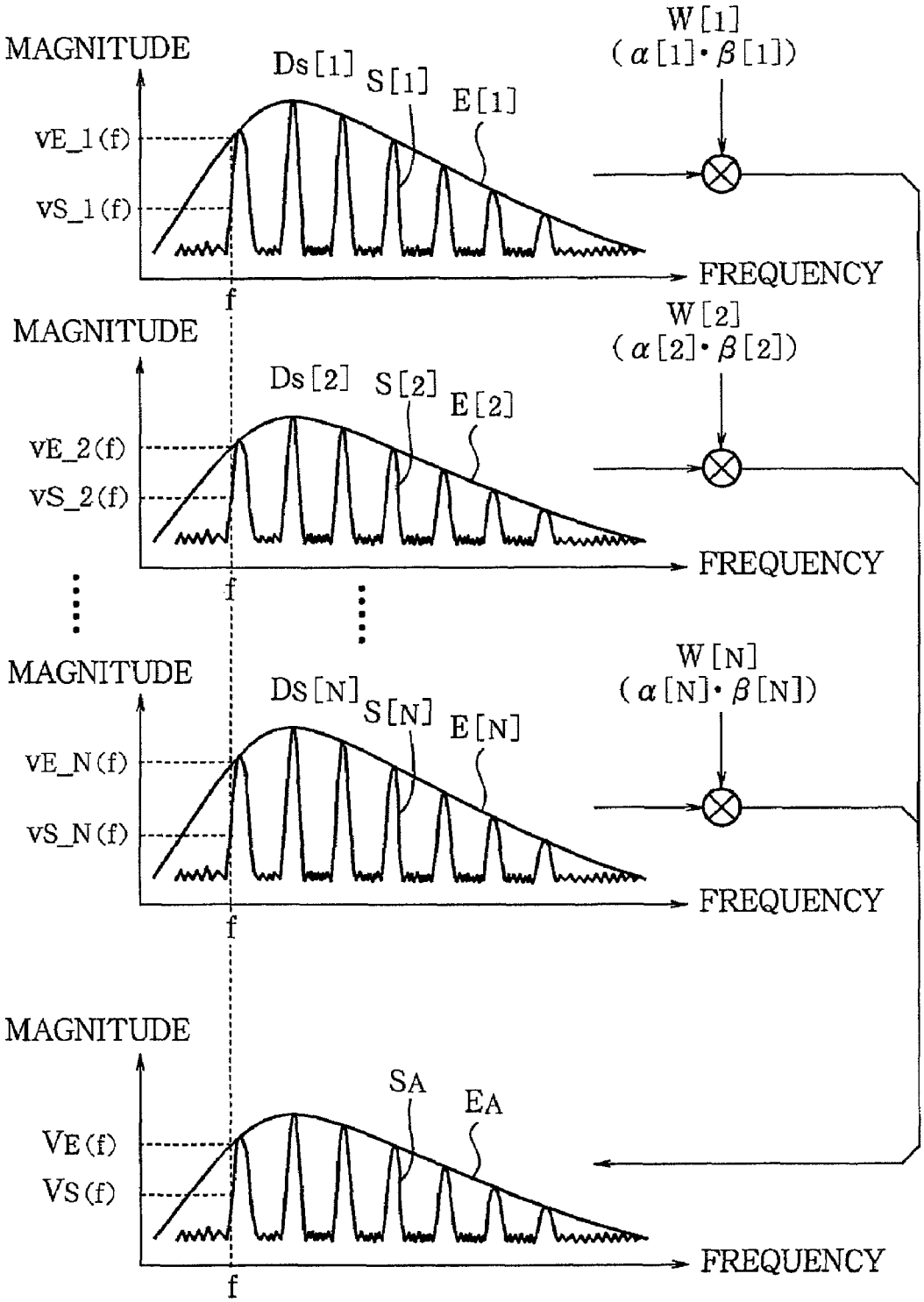
FIG. 6 is a schematic diagram illustrating the operation of a sound synthesis unit (an adjustment unit).

FIG. 6 illustrates N sound element data $D_S$ ($D_S$[1] to $D_S$[N]) acquired from the storage device 12 according to the sound element of the selected designated sound. Sound element data $D_S$[i] extracted from sound data D[i] represents a frequency spectrum S[i] and an envelope E[i]. As shown in FIG. 6, the sound synthesis unit 42 includes an adjustment unit 46 that generates an envelope $E_A$ from the envelopes E[1] to E[N] and also generates a frequency spectrum $S_A$ from the frequency spectrums S[1] to S[N] as shown in FIG. 6. Detailed operations of the adjustment unit 46 will be described later.

Figure 7:
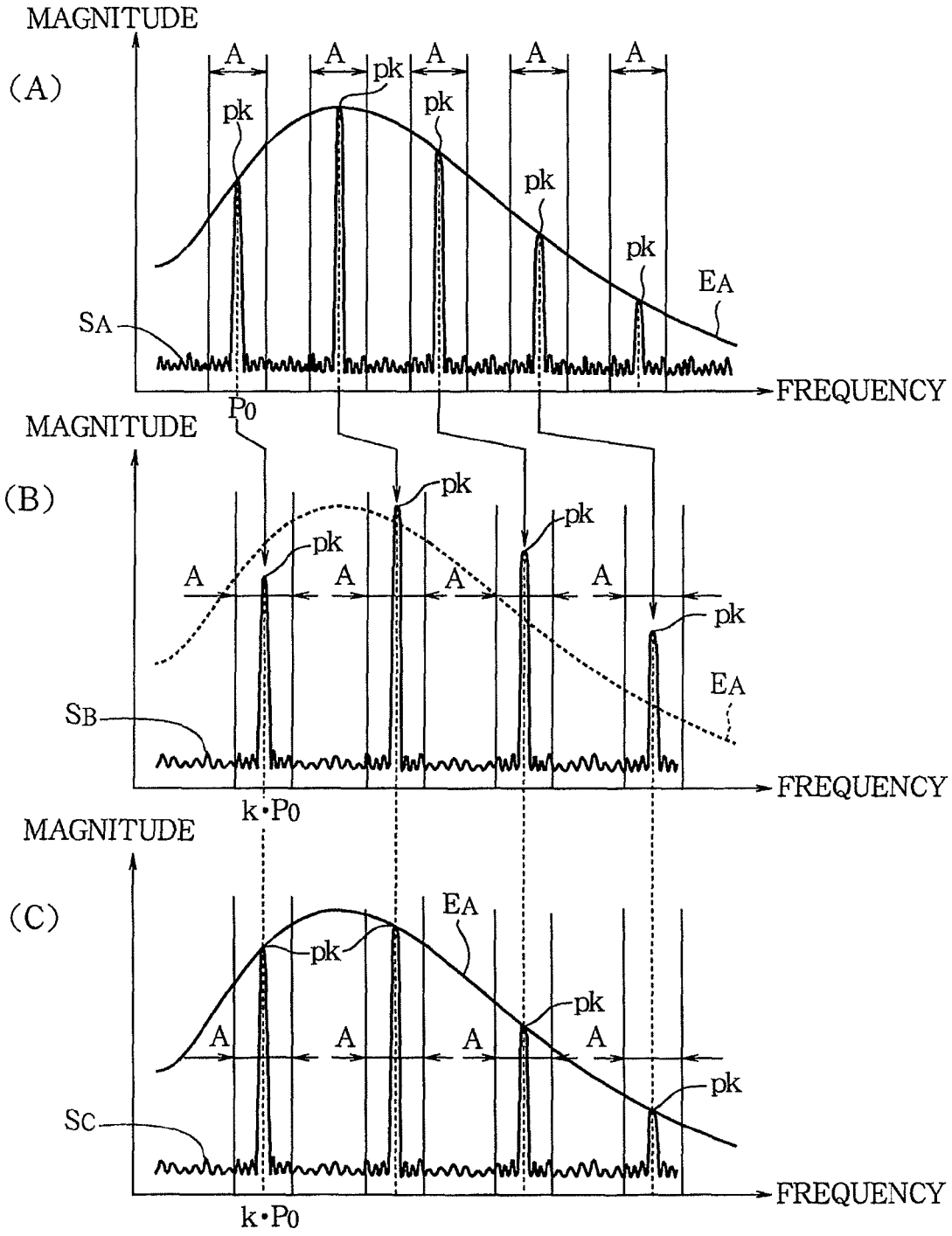
FIG. 7 is a schematic diagram illustrating the operation of the sound synthesis unit.

FIG. 7 is a conceptual diagram illustrating the operation of the sound synthesis unit 42. As shown in FIG. 7(A), in the frequency spectrum $S_A$ generated by the adjustment unit 46, a local peak pk is present at each of a fundamental frequency (pitch) P0 and harmonics of the sound. The sound synthesis unit 42 detects local peaks pk from the frequency spectrum $S_A$ generated by the adjustment unit 46 and specifies a distribution A for each local peak pk in the frequency spectrum $S_A$ such that the distribution A spans a predetermined bandwidth, centered on the local peak pk in the frequency axis. In the following description, the distribution A is referred to as a "local peak distribution".

The sound synthesis unit 42 sequentially performs a pitch conversion process and a magnitude adjustment process. The pitch conversion process is a process for expanding or contracting the frequency spectrum $S_A$ in the direction of the frequency axis. That is, the sound synthesis unit 42 calculates a conversion rate k by dividing a pitch PX that is designated for the selected designated sound in the music information $Q_A$ by the fundamental frequency $P_0$ of the frequency spectrum $S_A$ (i.e., k=Px/P0) and expands (when the conversion rate k is greater than "1") or contracts (when the conversion rate k is less than "1") the frequency spectrum $S_A$ in the direction of the frequency axis by a ratio corresponding to the conversion rate k to generate a frequency spectrum $S_B$ as shown in FIG. 7(B). For example, the sound synthesis unit 42 generates the frequency spectrum $S_B$ by moving each local peak distribution A of the frequency spectrum $S_A$ along the frequency axis such that each local peak pk of the frequency spectrum $S_A$ is located at a frequency which is the product of the frequency of the local peak pk and the conversion rate k and expanding or contracting components of an interval between each local peak distribution A, which has not been moved, along the frequency axis, and then disposing the expanded or contracted component between each local peak distribution A which has been moved.

The magnitude adjustment process is a process for adjusting the magnitude (i.e., amplitude) of the frequency spectrum $S_B$ that has been expanded or contracted to generate a frequency spectrum $S_C$. The magnitude adjustment process uses the envelope $E_A$ generated by the adjustment unit 46. More specifically, the sound synthesis unit 42 generates the frequency spectrum $S_C$ by increasing or decreasing the magnitude of each local peak distribution A of the frequency spectrum $S_B$ such that a curve connecting each local peak pk of the frequency spectrum $S_B$ matches the envelope $E_A$ as shown in FIG. 7C (i.e., such that the top of each local peak pk is located on the envelope $E_A$). That is, the sound synthesis unit 42 adjusts the magnitude of each local peak pk of the frequency spectrum $S_B$ so as to be equal to the magnitude of a frequency corresponding to the local peak pk in the envelope $E_A$. The sound synthesis unit 42 generates a sound signal $S_{OUT}$ by converting (i.e., inverse Fourier transforming) the frequency spectrum $S_C$ generated through the above procedure into time-domain waveform signals and connecting the converted signals along the time axis. Details of the sound synthesis method illustrated above are also described in Japanese Patent Application Publication No. 2007-240564.

The following is a detailed description of how the adjustment unit 46 calculates the envelope $E_A$ and the frequency spectrum $S_A$. As shown in FIG. 6, the adjustment unit 46 calculates, as the envelope $E_A$, a weighted sum of the envelopes E[1] to E[N] represented by N sound element data $D_S$[1] to $D_S$[N] corresponding to the sound element of the selected designated sound in the sound data group G. More specifically, a magnitude VE(f) at each frequency f in the envelope $E_A$ is defined as the sum (i.e., a weighted sum) of the magnitudes vE_i(f) of the frequency f of envelopes E[i] multiplied by weights W[i] for N envelopes E[1] to E[N] (i.e., for all i from 1 to N) as represented in the following Equation (1). That is, the adjustment unit 46 generates the envelope $E_A$ corresponding to the envelopes E[1] to E[N] by performing calculation of the following Equation (1).

$$VE(f)=W[1]\cdot vE_1(f)+W[2]\cdot vE_2(f)+\ldots+W[N]\cdot vE_N(f) \quad (1)$$

Similarly, the adjustment unit 46 calculates, as the frequency spectrum $S_A$, a weighted sum of the frequency spectrums S[1] to S[N] represented by N sound element data $D_S$[1] to $D_S$[N] corresponding to the sound element of the selected designated sound in the sound data group G. More specifically, a magnitude VS(f) at each frequency f in the frequency spectrum $S_A$ is defined as the sum (i.e., a weighted sum) of the magnitudes vS_i(f) of the frequency f of frequency spectrums S[i] multiplied by weights W[i] for N envelopes S[1] to S[N] (i.e., for all i from 1 to N) as represented in the following Equation (2). That is, the adjustment unit 46 generates the frequency spectrum $S_A$ corresponding to the frequency spectrums S[1] to S[N] by performing calculation of the following Equation (2).

$$VS(f)=W[1]\cdot vS_1(f)+W[2]\cdot vS_2(f)+\ldots+W[N]vS_N(f) \quad (2)$$

The weight W[i] applied to both the magnitude vE_i(f) of the envelope E[i] in Equation (1) and the magnitude vS_i(f) of the frequency spectrum S[i] in Equation (2) is determined according to the sound receiving information $Q_B$ set by the setting unit 44 and the position P[i] designated in the sound data D[i] (i.e., the position of the sound collecting device M[i] at which the sound was recorded). More specifically, the weight W[i] is determined to be the product of a factor α[i] and a factor β[i] (W[i]=α[i]·β[i]). The factor α[i] is calculated according to the distance between the position P[i] and the position $P_U$ of the virtual sound receiving point U. The factor β[i] is calculated according to the direction of the position P[i] from the position $P_U$ and the directionality attributes of sound reception at the sound receiving point U such as the directionality mode $t_U$, the sound receiving sensitivity $h_U$, and the sound receiving direction $d_U$. The adjustment unit 46 calculates the factor α[i] and the factor β[i] in the following manner.

Figure 8:
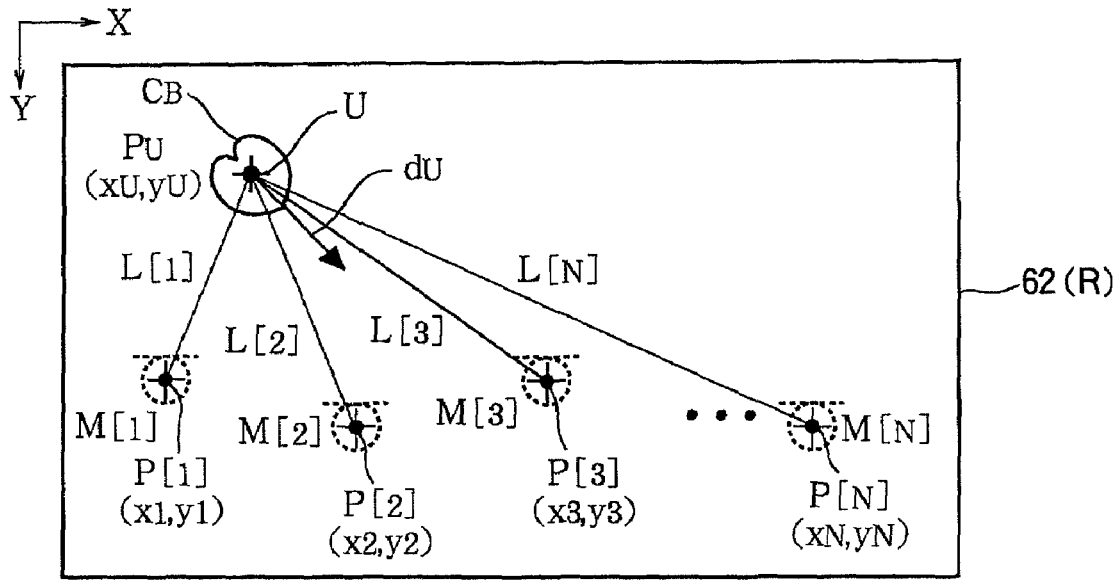
FIG. 8 is a schematic diagram illustrating calculation of a factor $\alpha[i]$.

First, a description is given of the calculation of the factor α[i]. As shown in FIG. 8, the adjustment unit 46 calculates the distance L[i] between the position P[i] of the sound collecting device M[i] in the space R at which the sound was recorded and the position $P_U$ of the sound receiving point U specified in the sound receiving information $Q_B$ for each of the N positions P[1] to P[N]. For example, the distance L[i] is a Euclidean distance calculated from the coordinates (xi, yi) of the position P[i] and the coordinates (xU, yU) of the position $P_U$ in the x-y plane. The adjustment unit 46 calculates, as the factor α[i], the ratio of the inverse of the distance L[i] to the total sum of the inverses of the distances L[1] to L[N] calculated respectively for the N positions P[1] to P[N] as defined by the following Equation (3).

$$\alpha[i] = \frac{\frac{1}{L[i]}}{\sum_{n=1}^{N} \frac{1}{L[n]}} \tag{3}$$

As can be understood from Equation (3), the factor α[i] increases as the position $P_U$ of the sound receiving point U and the position P[i] of the sound collecting device M[i] at which the sound was recorded get closer to each other (i.e., as the distance L[i] decreases). Accordingly, the influence of the sound element data $D_S$[i] of the sound data D[i] (i.e., the influence of the envelope E[i] and the frequency spectrum S[i]) upon the envelope $E_A$ or the frequency spectrum $S_A$ generated by the adjustment unit 46 increases as the position P[i] at which the sound data D[i] is recorded gets closer to the sound receiving point U (i.e., the position $P_U$) designated by the user.

Figure 9:
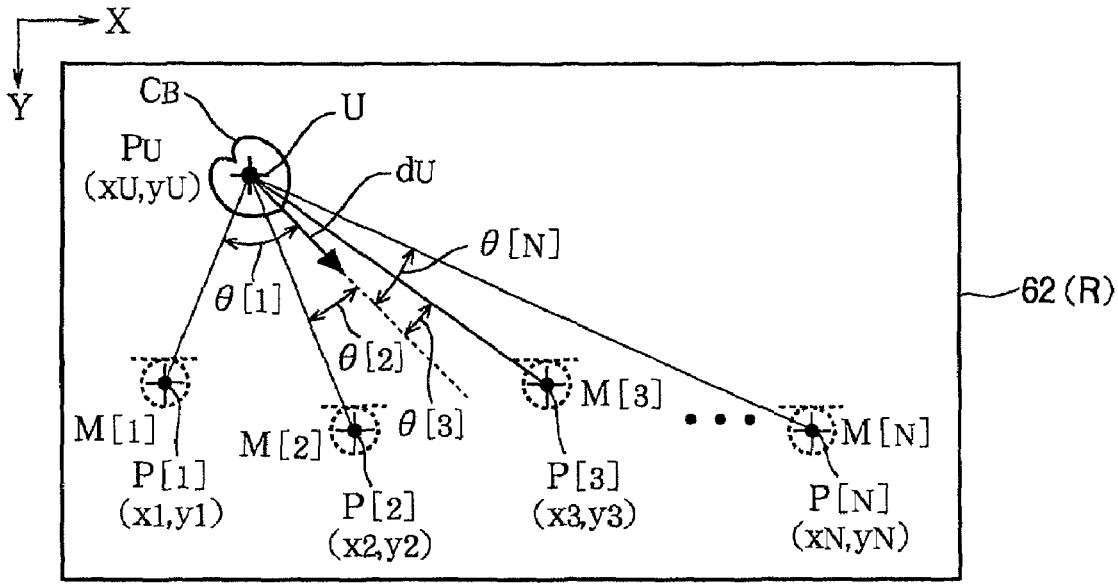
FIG. 9 is a schematic diagram illustrating calculation of a factor $\beta[i]$.

Next, a description is given of the calculation of the factor β[i]. As shown in FIG. 9, the adjustment unit 46 calculates the angle of elevation θ[i] between the direction of the position P[i] of each sound collecting device M[i] from the position $P_U$ of the sound receiving point U designated in the sound receiving information $Q_B$ and the sound receiving direction $d_U$ designated in the sound receiving information $Q_B$ for each of the N positions P[1] to P[N]. The sound receiving direction $d_U$ is a reference direction from which the angle θ[i] is measured (i.e., the angle θ[i] of the sound receiving direction $d_U$ is 0). The angle θ[i] is calculated using both the position $P_U$ (coordinates (xU, yU)) designated in the sound receiving information $Q_B$ and the position P[i] (coordinates (xi, yi)) designated in the sound data D[i].

The adjustment unit 46 then calculates a sensitivity r[i] of a sound wave that arrives at the sound receiving point U at the angle θ[i] using a sensitivity function corresponding to the directionality mode $t_U$ designated in the sound receiving information $Q_B$. The sensitivity function defines the sensitivity of a sound wave arriving at the sound receiving point U in each direction. For example, a sensitivity function of Equation (4A) is used when unidirectionality (i.e., cardioid) has been designated as the directionality mode $t_U$, a sensitivity function of Equation (4B) is used when omnidirectionality has been designated as the directionality mode $t_U$, and a sensitivity function of Equation (4C) is used when bidirectionality has been designated as the directionality mode $t_U$.

$$r[i]=\tfrac{1}{2}\cdot\cos\theta[i]+\tfrac{1}{2} \tag{4A}$$

$$r[i]=1 \tag{4B}$$

$$r[i]=\cos\theta[i] \tag{4C}$$

The adjustment unit 46 calculates, as the factor β[i], the product of the sound receiving sensitivity $h_U$ designated in the sound receiving information $Q_B$ and the ratio of the sensitivity r[i] to the total sum of the sensitivities r[1] to r[N] calculated respectively for the N positions P[1] to P[N] as defined by the following Equation (5).

$$\beta[i] = hU \cdot \frac{r[i]}{\sum_{n=1}^{N} r[n]} \tag{5}$$

The factor β[i] increases as the sensitivity r[i] increases as can be understood from Equation (5). Accordingly, the influence of the sound element data $D_S$[i] of the sound data D[i] (i.e., the influence of the envelope E[i] and the frequency spectrum S[i]) upon the envelope $E_A$ or the frequency spectrum $S_A$ generated by the adjustment unit 46 increases as the sensitivity of sound reception at the sound receiving point U (i.e., at the position $P_U$) increases, for which the user has designated the directionality mode $t_U$ and the sound receiving direction $d_U$, in the direction from the position P[i] at which the sound data D[i] was collected.

As described above, in this embodiment, the envelope E[i] or the frequency spectrum S[i] specified by the sound element data $D_S$[i] is used to generate the envelope $E_A$ or the frequency spectrum $S_A$ after the envelope E[i] or the frequency spectrum S[i] is weighted according to relations (such as the distance L[i] and the angle θ[i]) between the position P[i] of the sound collecting point (i.e., the sound collecting device M[i]) in the space R and the position $P_U$ designated by the user. Accordingly, it is possible to synthesize a sound that would be received by a virtual sound receiving point U assuming that the virtual sound receiving point U was disposed at the position $P_U$ in the space R. In addition, since sound receiving attributes at the sound receiving point U such as the directionality mode $t_U$, the sound receiving sensitivity $h_U$, and the sound receiving direction $d_U$ are variably set according to an instruction from the user, this embodiment has an advantage in that it is possible to synthesize a sound that would be received by a sound receiving device having characteristics desired by the user when the sound receiving device is virtually disposed in the space R.

B: Second Embodiment

The following is a description of the second embodiment of the invention. In each of the following embodiments, the same elements as those of the first embodiment are denoted by the same reference numerals and a detailed description thereof is appropriately omitted.

Figure 10:
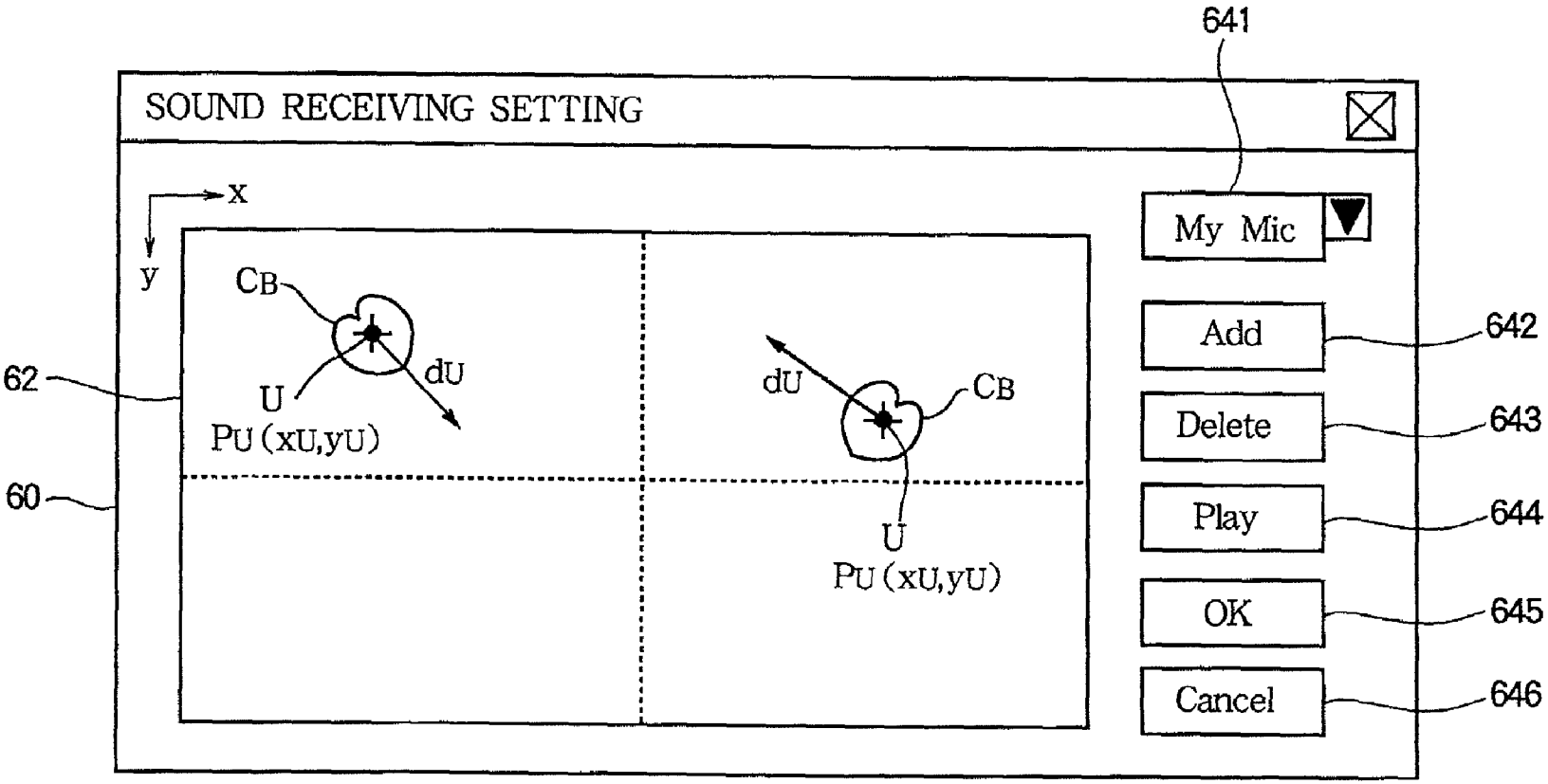
FIG. 10 is a schematic diagram of a sound receiving setting image in a second embodiment of the invention.
Figure 11:
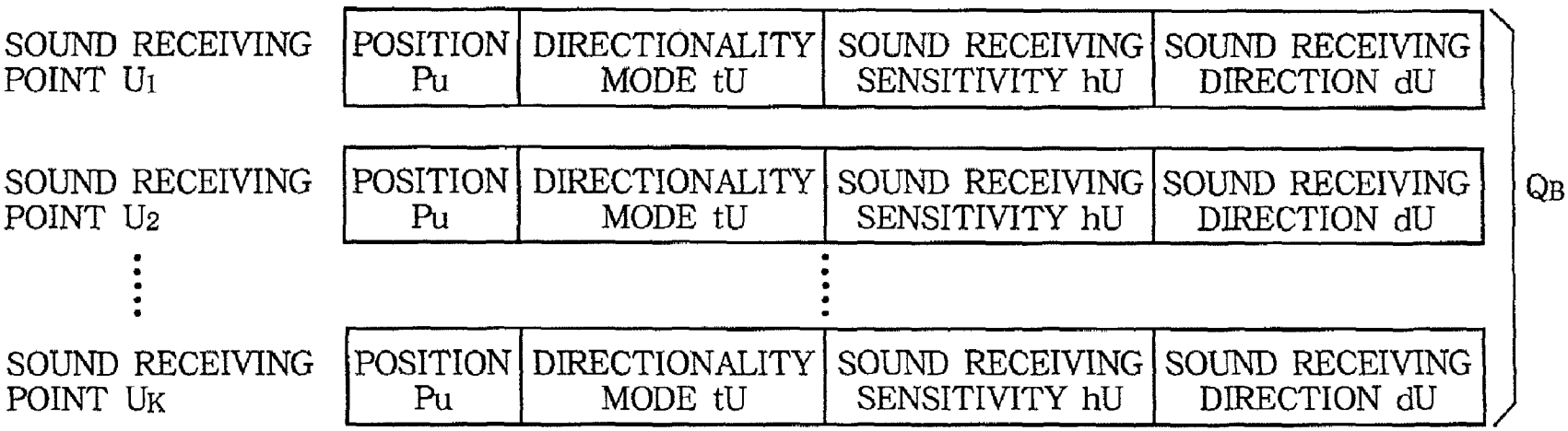
FIG. 11 is a schematic diagram of sound receiving information.

FIG. 10 is a schematic diagram of a sound receiving setting image 60 in this embodiment. As shown in FIG. 10, a plurality of (K) sound receiving points U are disposed in a work area 62 according to an operation that the user performs on the input device 22. For each of the K sound receiving points U, the setting unit 44 individually sets a position $P_U$, a directionality mode $t_U$, a sound receiving sensitivity $h_U$, and a sound receiving direction $d_U$ of the sound receiving point U according to an operation performed on the input device 22. As shown in FIG. 11, sound receiving information $Q_B$ stored in the storage device 12 includes variables such as the position $P_U$, the directionality mode $t_U$, the sound receiving sensitivity $h_U$, and the sound receiving direction $d_U$ that the setting unit 44 have set for each of the K sound receiving points U (U1, U2, . . . , UK).

For each of the K sound receiving points U, the adjustment unit 46 generates an envelope $E_A$ and a frequency spectrum $S_A$ according to variables corresponding to the sound receiving point U in the sound receiving information $Q_B$ using the same method as that of the first embodiment. For each of the K sound receiving points U, the sound synthesis unit 42 generates a sound signal $S_{OUT}$ according to the envelope $E_A$ and the frequency spectrum $S_A$ that the adjustment unit 46 has calculated for the sound receiving point U using the same method as that of the first embodiment. The K sound signals $S_{OUT}$ generated in this manner are output to the sound output device 26 after being mixed together through the sound synthesis unit 42. In addition to the same advantages as those of the first embodiment, this embodiment has an advantage in that it is possible to synthesize sounds that would be received by a plurality of sound receiving points U in the space R.

C: Third Embodiment

Figure 12:
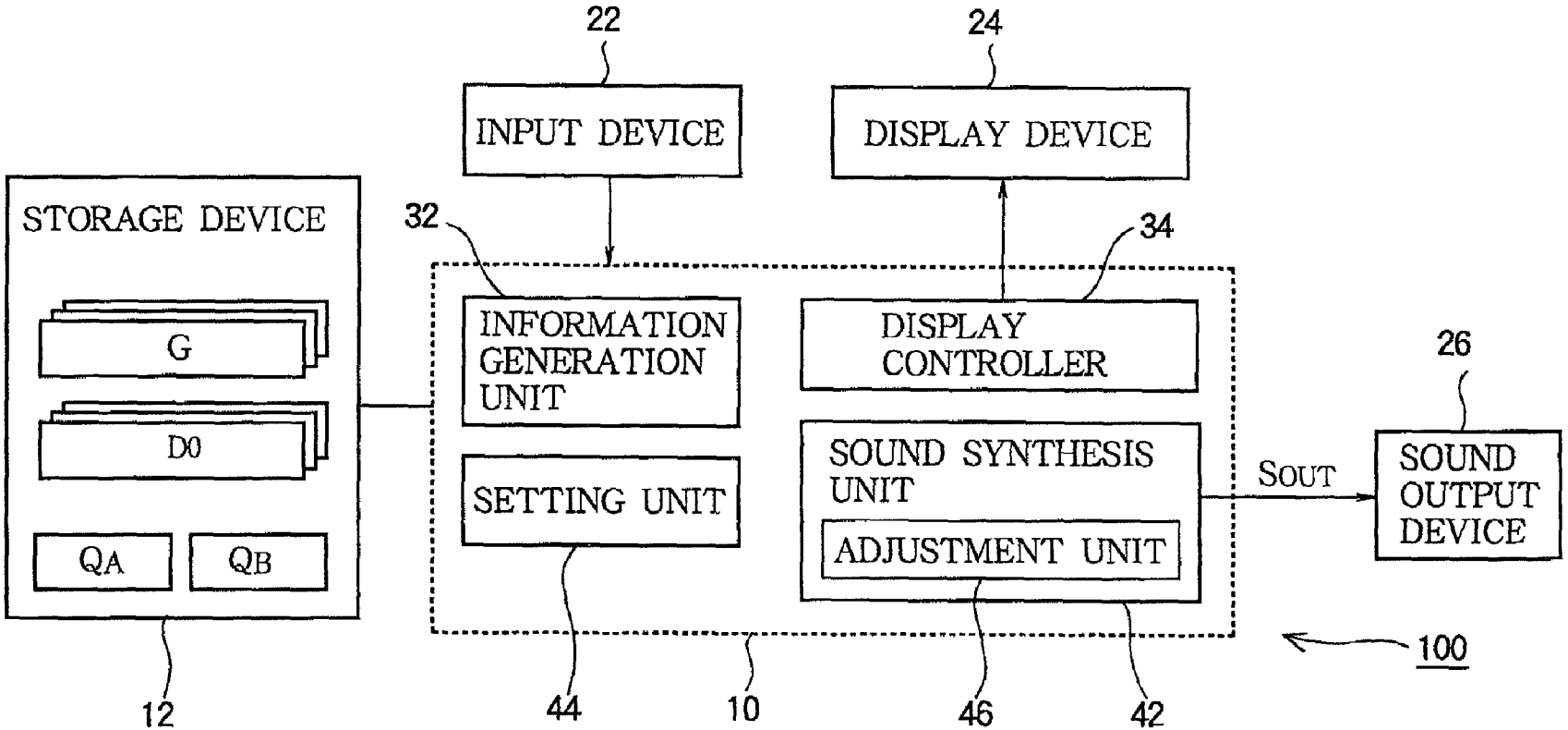
FIG. 12 is a block diagram of a sound synthesizer according to a third embodiment of the invention.

FIG. 12 is a block diagram of a sound synthesizer 100 according to the third embodiment of the invention. As shown in FIG. 12, a storage device 12 of this embodiment stores a plurality of sound data groups G and a plurality of sound data $D_0$. Each of the plurality of the sound data groups G is individually generated from each of a plurality of sounds having different characteristics (for example, vocal sounds generated by different persons u or vocal sounds generated in different spaces R), and includes a plurality of sound data $D_0$ representing the features of sounds that have been collected in parallel at individual positions, similar to the first embodiment. Similar to the sound data D, each of the plurality of the sound data $D_0$ includes a plurality of sound element data $D_S$ respectively representing the features of a plurality of sound elements of a sound received by a single sound collecting device.

Figure 13:
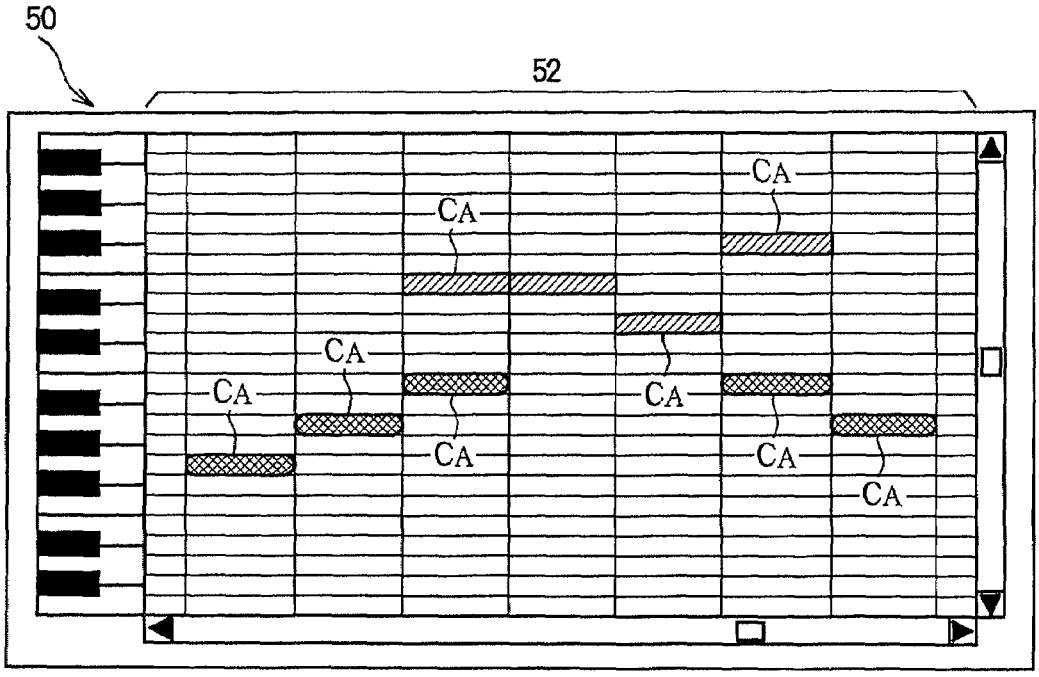
FIG. 13 is a schematic diagram of a music editing image.

FIG. 13 is a schematic diagram of a music editing image 50. The user allocates a desired sound data group G or sound data $D_0$ to each indicator $C_A$ (each designated sound) in a work area 52 by appropriately operating an input device 22. An information generation unit 32 stores the identifier of the sound data group G or sound data $D_0$, which the user has allocated to the designated sound, in music information $Q_A$ in association with the designated sound. For each selected designated sound for which the identifier of the sound data group G is set in the music information $Q_A$, a sound synthesis unit 42 synthesizes a sound signal $S_{OUT}$ using the sound data group G and sound receiving information $Q_B$ according to the same method as that of the first embodiment. For each selected designated sound for which the identifier of the sound data $D_0$ is set in the music information $Q_A$, the sound synthesis unit 42 synthesizes a sound signal $S_{OUT}$ using an envelope E and a frequency spectrum S represented by sound element data $D_S$ of the sound data $D_0$ as an envelope $E_A$ and a frequency spectrum $S_A$ according to the same method as that of FIG. 7.

As shown in FIG. 13, a display controller 34 displays each indicator $C_A$ to which a sound data group G has been allocated and each indicator $C_A$ to which sound data $D_0$ has been allocated on a display device 24 in different modes. The modes of the indicator $C_A$ are states of the indicator $C_A$ which allow the user to visually identify the indicator $C_A$. Typical examples of the modes of the indicator $C_A$ include display color attributes (such as hue, brightness, and saturation), shapes, or sizes of the indicator $C_A$. By identifying the mode of each indicator $C_A$, the user can discriminate between each designated sound to which a sound data group G has been allocated and each designated sound to which sound data $D_0$ has been allocated. This embodiment achieves the same advantages as those of the first embodiment.

D: Modifications

Various modifications can be made to each of the above embodiments. The following are specific examples of such modifications. It is also possible to optimally select and combine two or more from the above embodiments or the following modifications.

(1) Modification 1

Although each of the above embodiments has been exemplified by the case where a plurality of persons u generate vocal sounds in the space R when a sound data group G is generated (i.e., the case where a sound data group G of choral sounds is generated), it is also preferable to employ a configuration wherein a sound data group G is generated from a (solo) vocal sound generated by one person u. Although a human vocal sound is collected to generate sound data D (sound data $D_0$ in the third embodiment) in each of the above embodiments, it is also possible to employ a configuration wherein the sound data D ($D_0$) represents a sound played by an instrument.

(2) Modification 2

Although each of the above embodiments has been exemplified by the case where sound collecting points (sound collecting devices M[i]) are disposed in plane (i.e., in two dimensions) in the space R, each of the above embodiments is applied in the same manner to the case where sound collecting points (sound collecting devices M[i]) are disposed in three dimensions in the space R. In the case where sound collecting points (sound collecting devices M[i]) are disposed in three dimensions, each position P[i] is defined by 3-dimensional coordinates in an x-y-z space R.

(3) Modification 3

The sound synthesis unit 42 may use any known technology to synthesize a sound. A method for reflecting the sound receiving information $Q_B$ in the synthesized sound is appropriately selected according to the synthesis method used by the sound synthesis unit 42 (specifically, according to variables used for synthesis). In addition, although sound receiving information $Q_B$ (specifically, weights W[1] to W[N]) is reflected in both the envelopes E[1] to E[N] and the frequency spectrums S[1] to S[N] in each of the above embodiments, it is also possible to employ, for example, a configuration wherein the envelope $E_A$ is generated according to the sound receiving information $Q_B$ using the method of FIG. 6 while one of the frequency spectrums S[1] to S[N] (or the average of the frequency spectrums S[1] to S[N]) is used as the frequency spectrum $S_A$ of FIG. 7.

(4) Modification 4

The contents of the sound receiving information $Q_B$ are changed appropriately from the above examples. For example, at least one of the directionality mode $t_U$, the sound receiving sensitivity $h_U$, and the sound receiving direction $d_U$ is omitted. Only one type of sensitivity function is applied to calculate the factor β[i] in a configuration wherein the directionality mode $t_U$ is omitted and the variable hU of Equation (5) is set to a predetermined value (for example, "1") in a configuration wherein the sound receiving sensitivity $h_U$ is omitted. It is also preferable to employ a configuration wherein the calculation of Equation (1) or (2) is performed using only one of the factors α[i] and β[i] as the weight W[i]. As understood from the above examples, the invention preferably employs a configuration wherein a sound is synthesized by processing each of the plurality of the sound data D (D[1] to D[N]) according to the relation (such as the distance L[i] or the angle θ[i]) between the position $P_U$ of the sound receiving point U and the sound collecting position P[i] corresponding to the sound data D[i].

(5) Modification 5

The contents of the sound element data $D_S$ are not limited to the above examples such as the frequency spectrum S and the envelope E. For example, it is also possible to employ a configuration wherein the sound element data $D_S$ represents a waveform of the sound element on the time axis. In the case where the sound element data $D_S$ represents the waveform of the sound element, the sound synthesis unit 42 uses, for example, the sound element data $D_S$ to synthesize the sound after calculating the frequency spectrum S or the envelope E by performing frequency analysis including discrete Fourier transform on the sound element data $D_S$.

What is claimed is:

1. A sound synthesizer comprising:

a storage that stores a plurality of sound data respectively representing a corresponding plurality of sounds collected by a plurality of sound collecting devices positioned at different locations with respect to the location of at least one sound source, each of said plurality of sound collecting devices collecting at least one of said plurality of sounds;

a setting unit that variably sets a position of a sound receiving point with respect to the location of said at least one sound source according to an instruction received from a user; and a sound synthesis unit that synthesizes a synthesized sound by processing each of the plurality of the sound data according to a positional relation between the position of each of the sound collecting devices corresponding to the sound data and the position of the sound receiving point as set according to the instruction received from the user.

2. The sound synthesizer according to claim 1, wherein the sound synthesis unit synthesizes the synthesized sound by processing each of the plurality of the sound data according to a distance between the sound collecting device corresponding to the sound data and the sound receiving point.

3. The sound synthesizer according to claim 1, wherein the setting unit variably sets a directionality attribute of the sound receiving point according to an instruction from a user, and wherein the sound synthesis unit synthesizes the synthesized sound by processing each of the plurality of the sound data according to a sensitivity that the directionality attribute represents for a direction of the position of the sound collecting device corresponding to the sound data from the sound receiving point.

4. The sound synthesizer according to claim 3, wherein the setting unit sets at least one of a sound receiving direction and a directionality type as the directionality attribute of the sound receiving point.

5. The sound synthesizer according to claim 1, wherein the sound synthesis unit weighs an envelope of a frequency spectrum of a sound represented by each of the plurality of the sound data by a factor according to a relation between the position of the sound collecting device corresponding to the sound data and the position of the sound receiving point, then calculates a new envelope by summing the weighted envelopes of the frequency spectrums of the sounds represented respectively by the plurality of the sound data, and synthesizes the sound based on the new envelope.

6. A machine readable recording medium for use in a computer having a processor and a storage that stores a plurality of sound data respectively representing a corresponding plurality of sounds collected by a plurality of sound collecting devices positioned at different locations with respect to the location of at least one sound source, each of said plurality of sound collecting devices collecting at least one of said plurality of sounds, the medium containing program instructions executable by the processor to perform:

a setting process to variably set a position of a sound receiving point with respect to the location of said at least one sound source according to an instruction received from a user; and a sound synthesis process to synthesize a synthesized sound by processing each of the plurality of the sound data according to a positional relation between the position of each of the sound collecting devices corresponding to the sound data and a position of the sound receiving point as set according to the instruction received from the user.

* * * * *